US005627516A

United States Patent [19]

Balch et al.

[11] Patent Number: 5,627,516

[45] Date of Patent: May 6, 1997

[54] ELECTRONIC ARTICLE SURVEILLANCE INPUT CONFIGURATION CONTROL SYSTEM EMPLOYING EXPERT SYSTEM TECHNIQUES FOR DYNAMIC OPTIMIZATION

[75] Inventors: Brent F. Balch, Fort Lauderdale; William R. Accolla, Loxahatchee; Scott A. Tribbey, Pompano Beach, all of Fla.

[73] Assignee: Sensormatic Electronics Corporation, Deerfield Beach, Fla.

[21] Appl. No.: 313,848

[22] Filed: Sep. 28, 1994

[51] Int. Cl.[6] ..... G08B 13/14

[52] U.S. Cl. ..... 340/572; 340/551

[58] Field of Search ..... 340/572, 551

[56] References Cited

U.S. PATENT DOCUMENTS

| | | | |
|---|---|---|---|
| 4,394,645 | 7/1983 | Humble et al. | 340/572 |
| 4,769,631 | 9/1988 | Copeland | 340/551 |
| 4,906,973 | 3/1990 | Karbowski et al. | 340/551 |
| 4,994,939 | 2/1991 | Rubertus et al. | 340/572 X |
| 5,397,986 | 3/1995 | Conway et al. | 340/551 X |
| 5,495,229 | 2/1996 | Balch et al. | 340/551 |

*Primary Examiner*—Thomas Mullen

*Attorney, Agent, or Firm*—Robin, Blecker, Daley & Driscoll

[57] ABSTRACT

An electronic article surveillance system has a receiver with a plurality of receiving coils. Each coil in the system is treated as a separate detection unit with its own noise environment which is distinct from the noise environments of the other coils in the system. The picture of the noise environment is preferably expanded to include examining noise per coil per phase. Control apparatus has facility for changing the interconnection and configuration of the receiving coils responsively to the per coil and per phase noise environment analysis. Noise analysis and coil configuration change can be practiced concurrently with EAS system operation or may be practiced during periods in which the EAS system is rendered inactive.

20 Claims, 12 Drawing Sheets

ELECTRONIC ARTICLE SURVEILLANCE INPUT CONFIGURATION CONTROL SYSTEM EMPLOYING EXPERT SYSTEM TECHNIQUES FOR DYNAMIC OPTIMIZATION

FIELD OF THE INVENTION

This invention relates generally to electronic article surveillance (EAS) and pertains more particularly to improved EAS systems.

BACKGROUND OF THE INVENTION

One present commercially implemented EAS system of the assignee hereof has a transmitter which radiates a pulsed magnetic field into a surveillance area wherein it is desired to note the presence of articles bearing EAS tags, also referred to in the EAS industry as labels or markers. When a tagged article is present in the surveillance area, its tag is excited by the radiated magnetic field and, based on its composition, is caused to generate a detectable response signal. A receiver, which is enabled between successively spaced transmitter field radiations, detects the response signal of the tag and initiates an alarm or other activity to indicate the presence of the tag in the surveillance area.

EAS systems are commonly installed in environments with high levels of electrical interference, such as retail store checkout areas. Interference sources commonly found in these areas include such items as electronic cash registers, laser product code scanners, electronic scales, coin changers, printers, credit card verifiers, point of sale (POS) terminals, neon signs, fluorescent and halogen lights, conveyor belt motors and motor speed controllers, and others.

The electrical noise environment presented to an EAS system in a retail checkout area is rarely constant. Various electronic devices in the area, such as those listed above, are turned on and off throughout the day, causing an ever-changing pattern of interference, both in the time and frequency domains.

Conventional techniques of filtering, such as band limiting and frequency notching, require extra hardware and often do not eliminate the interfering signals. They rely on improving the desired signal-to-noise ratio (SNR) by attenuating undesired out-of-band signals, while amplifying signals of interest, namely, tag signals.

Time domain approaches, such as receiver blanking and time window masking (discussed below) are effective, but have the drawback requiring extra hardware. Further, when the receiver is blanked or masked, it is incapable of responding to valid tag signals.

Another known practice for addressing electrically noisy EAS environments is the use of a phase canceling receiver antenna scheme. The most common scheme makes use of a FIG.-8 antenna configuration, wherein two substantially identical antennas are connected either in series or parallel, such that signal sources at a distance generate magnetic flux that cuts both coils equally, inducing equal and opposite currents in the coils. When the currents from the coils are summed, they cancel and the net amplitude from the distant source is reduced. This method of noise cancellation is very effective for many types of interference, but has a significant disadvantage in that a tag placed on or near the plane of symmetry between the FIG.-8 receiver pair also has its signal canceled, i.e., the tag is said to be in a receiver null zone. At times, environmental interference is so severe that the presence of null zones represents an acceptable compromise.

Frequency band limiting, done by filtering, is also an effective means of reducing noise interference. System receiver input filtering selectively passes certain frequencies which include the expected tag frequency characteristics and suppresses or blocks frequencies outside of the passband. However, interfering signals have frequencies near the expected tag frequency and are within the passband and are processed in the receiver.

Limiters and noise blankers also have seen use in addressing environmental noise, addressing high level and particularly short duration impulse noise (noise spikes). However, under certain conditions, tag signals can erroneously activate these circuits, causing them to block the desired tag signals.

The commercial EAS system of the assignee hereof above referred to generates a pulsed magnetic field in the form of short bursts of magnetic flux at a frequency to which the system tags are sensitive. The system tags are magnetically resonant at the particular system frequency and because of their significant Q, they will continue to respond or "ring" after the transmitter field is removed. This ringing response is unique and is detected by the system receiver. To protect the sensitive receiver circuitry from being overwhelmed by the high level transmitter field, the receiver circuitry is gated off until shortly after the end of the transmitter burst. For this reason and to prevent interaction between systems, this transmitter burst and receiver window must occur at precise points in time, commonly referenced to the local power line's zero crossing.

Because of the possibility of neighboring systems being powered by different phases from the local power lines, three distinct transmit/receive windows are provided for in the systems' timing scheme, each 120 degrees apart in phase. This strict timing sequence must be adhered to in order to prevent undesired system interaction. This critical timing system has the advantage that noise spikes and impulsive noise occurring at times when the receiver is gated off do not interfere with the system. The processor in the system routinely monitors the background noise for all receiver antennas in all three possible receiver phases. A composite noise average is computed and receiver gain is adjusted up or down to optimize system sensitivity with a varying noise environment. As the background noise average increases, the receiver gain is reduced to allow a defined signal-to-noise ratio to be met without danger of linear stages clipping.

Some repetitive impulsive noise sources can produce interfering signals during receiver windows however, so the system provides for time window masking, which prevents these high noise windows from being included in the average and reducing system sensitivity. Setting this time window masking is a manual step performed at the time of system installation or during servicing of the system.

Once a receiver window is masked, noise during that period no longer affects the average, but the window can no longer be used to process signals. If the impulse noise source changes its phase relationship to the power line's zero crossing, such as if the source is another piece of electronic equipment which is relocated or replaced with another unit, its interfering signal now can occur during a non-masked receiver window, reducing system sensitivity, and the masked receiver window is not freed up for system use.

In a commonly-assigned, concurrently-filed patent application Ser. No. 08/313,849, entitled "PULSED ELECTRONIC ARTICLE SURVEILLANCE DEVICE EMPLOYING EXPERT SYSTEM TECHNIQUES FOR DYNAMIC OPTIMIZATION", The '849 application issued as U.S. Pat. No. 5,495,229 on Feb. 27, 1996. The problems of the prior art above discussed are addressed. That patent application embodies one fundamental concept, unlike the commercial system above discussed, where a single noise source could reduce sensitivity for the entire system. Thus, per the invention therein, each coil in the system is treated as a separate detection unit with its own noise environment which is distinct from the noise environments of the other coils in the system. This allows the system to optimize its performance by maximizing the sensitivity of each coil according to its own local noise environment.

In EAS systems in accordance with the invention of the referenced patent application, the priority of the detection routines is to keep an accurate and up-to-date picture of the noise environment for each coil in "noise phases" and to look for tags during "transmit phases". The picture of the noise environment preferably is expanded to include examining noise per coil per phase of a multi-phase power mains.

During "noise phases", the current in-band measurement taken at the front end of the receiver is added to a historical record of the noise for that particular coil and power mains phase while the oldest measurement is discarded. These measurements are then averaged to create the system's overall picture of the noise environment for that coil, and for each particular phase, where applicable. Typically, the record includes ten entries at any time.

During "transmit phases", receiver gain is set per coil and per phase correspondingly with the noise averages obtained per coil and per phase in the noise periods. The instantaneous measurement from a particular coil is compared with the noise average for that coil in that phase and if the ratio of the instantaneous to average values meets the user set signal-to-noise criterion, the coil output is taken as a tag return and the system enters a "validation sequence".

In the validation sequence, a tag is looked for iteratively for the user set number of successive "hits" and, in the penultimate look, the system introduces a check for the possibility that the tag return is from a deactivated tag.

The system has facility for controlling the number of cycles of validation sequences adaptively with the existing noise environment.

The system also incorporates a frequency-hopping algorithm which allows it to better detect labels with wide frequency distribution.

SUMMARY OF THE INVENTION

The primary object of the present invention is provide a further improved EAS system.

Another equally general object of the invention is to provide an EAS system with enhanced ability to successfully operate within high electrical noise environments.

A specific object of the invention is to enhance the tag detection capacity of the systems of the referenced patent application.

Applicants entitle the subject invention above as involving "expert system" techniques. As defined in the *McGraw-Hill Dictionary of Scientific and Technical Terms*, Fifth Edition, the term "expert system" is "a computer system composed of algorithms that perform a specialized, usually difficult professional task at the level of (or sometimes beyond the level of) a human expert". In attaining the foregoing objects, the invention embodies such expert system techniques.

In attaining the foregoing objects, the invention embodies one fundamental concept, unlike the commercial system above discussed, where the transmitting coils have a fixed interconnection configuration and the receiving coils have a fixed interconnection configuration. Thus, the invention herein looks to dynamically changing interconnection configuration of EAS coils in the face of changing environmental noise to maximize the sensitivity of the system.

In its preferred embodiment, the invention provides an addendum to the system of the referenced patent application, practiced either concurrently with EAS system operation or periodically while rendering the EAS system inactive, and employing the noise environment analyzer thereof, alternatively to setting receiver gain and evaluating returns in a validation sequence, to assess the effectiveness of a variety of coil interconnection configurations.

Specifically, the invention herein contemplates interconnection of coils in a "standard" configuration, below defined, or in other configuration, e.g., a "FIG.-8" configuration. To assess need for coil configuration change, the invention looks to an assessment of receiver coil noise criteria in a given receiver coil interconnection configuration as against a preselected receiver coil noise criteria. Where an existing coil configuration exceeds the preselected receiver coil noise criteria, the existing coil configuration is changed to another coil configuration.

The foregoing and other objects and features of the invention will be further understood from the following detailed description of preferred embodiments thereof and from the drawings, wherein like reference numerals identify like components throughout.

DETAILED DESCRIPTION OF PREFERRED EMBODIMENTS AND PRACTICES

Figure 1:
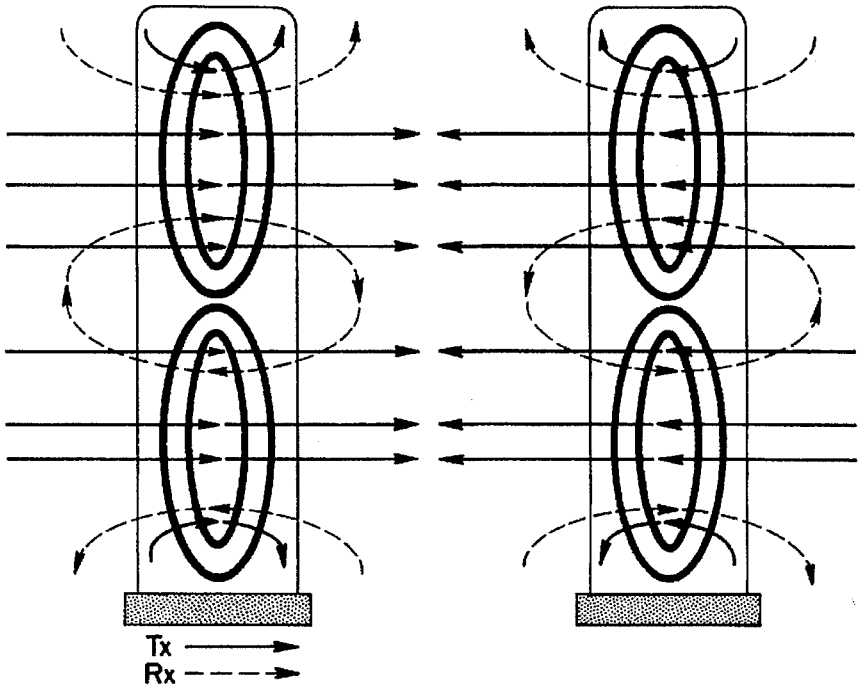
FIG. 1 (PRIOR ART)
FIGS. 1–4 are schematic showings of magnetic field configurations for a known plurality of coil configurations.
Figure 2:
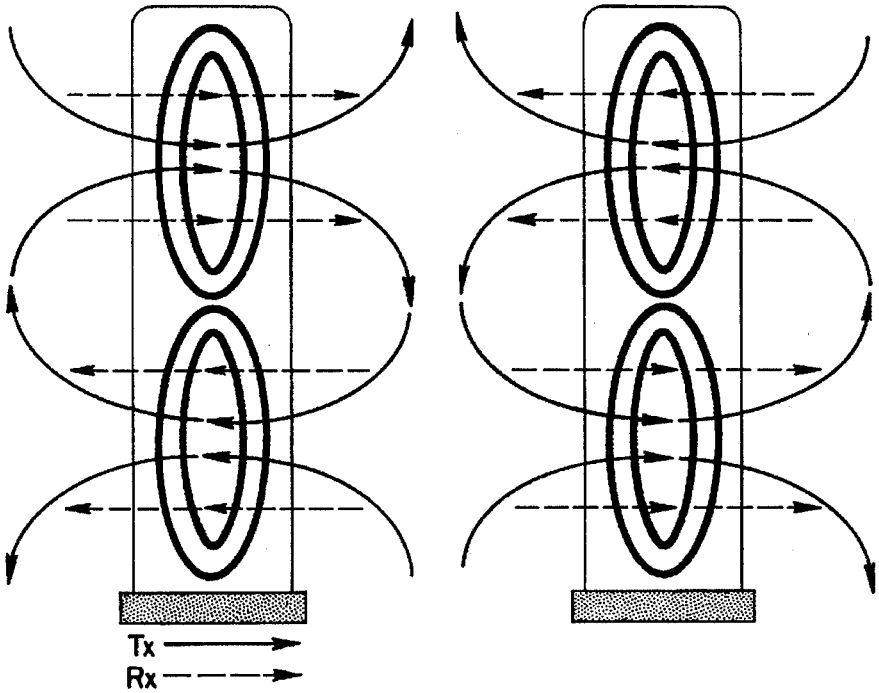
FIG. 2 (PRIOR ART)
Figure 3:
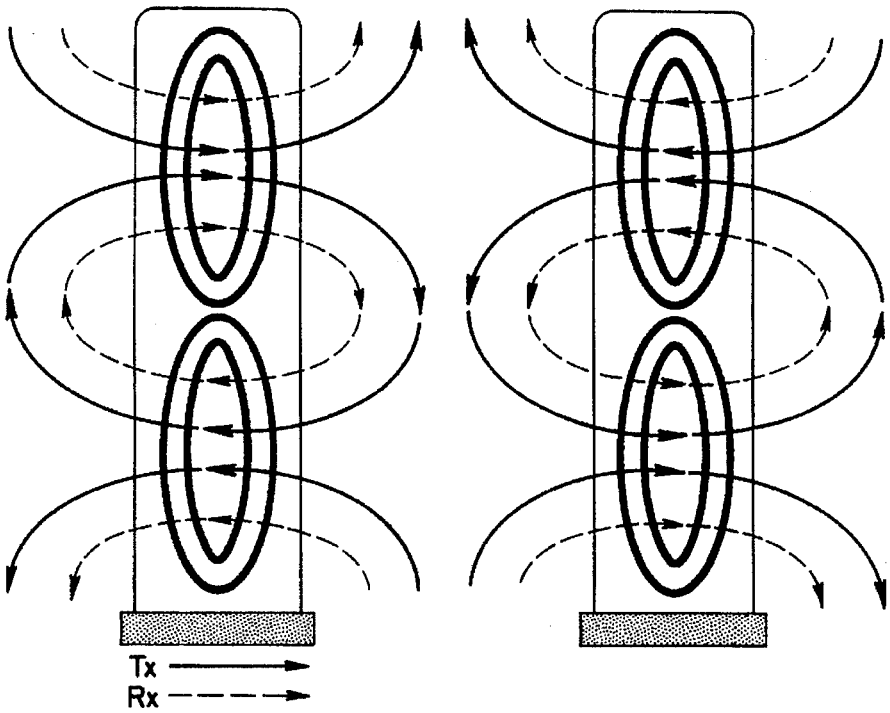
FIG. 3 (PRIOR ART)
Figure 4:
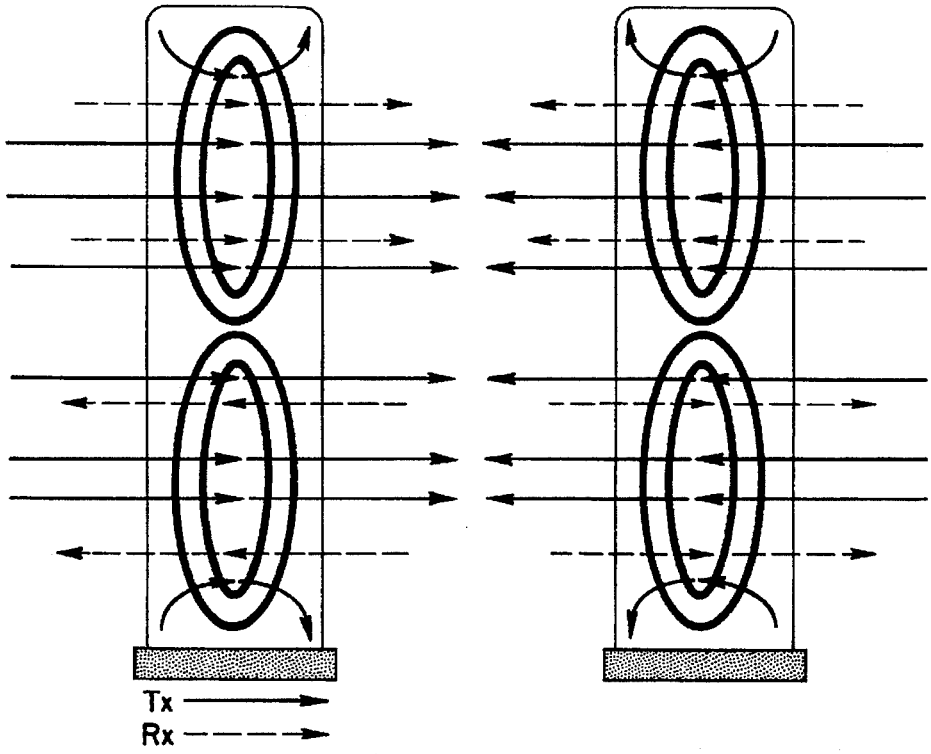
FIG. 4 (PRIOR ART)
Figure 8:
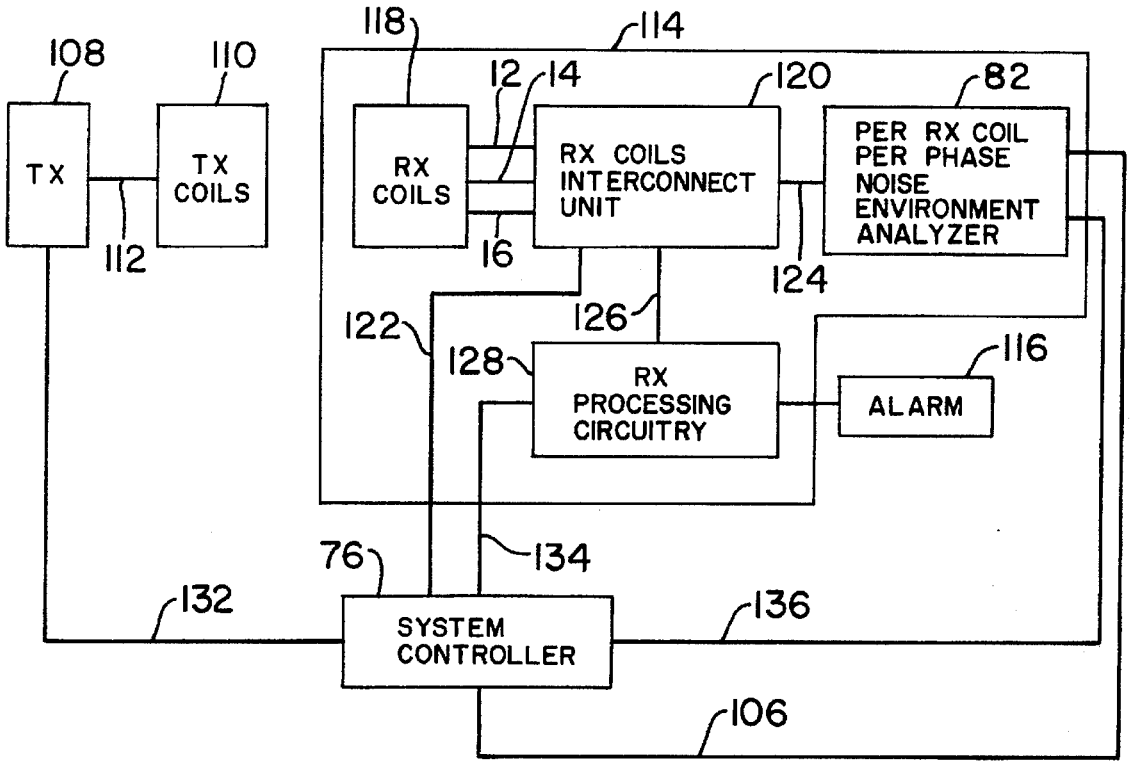
FIG. 8 shows a functional block diagram of a second embodiment of an EAS system in accordance with the invention.

Referring to FIG. 1, it depicts a magnetic field configuration between transmitting coils arranged in "standard" configuration, i.e., wherein both transmitting coil pairs are excited, but pairs in separate antenna assemblies oppose each other, and receiving coils are arranged in "FIG.-8" configuration. Flux lines are indicated in solid lines for the transmitting coils and in broken lines for the receiving coils. In FIG. 2, the transmitting coils are in FIG.-8 configuration and the receiving coils are in standard configuration. In FIG. 3, both the transmitting coils and the receiving coils are in FIG.-8 configuration. In FIG. 4, both the transmitting coils and the receiving coils are in standard configuration. Theoretically, the best configuration is for both the transmitting coils and the receiving coils to be in standard configuration. For the transmitting coils, this provides the highest overall field strength within the system. In many European countries this field strength exceeds the legal limits. Operating the transmitting coils in FIG.-8 mode provides far field cancellation of the transmit field, so the levels required to meet their regulatory limits are realizable. Individually scanning the receiver coils allows the tag to be sensed in more physical orientations and locations in the system than when in the FIG.-8 mode. The greatest drawback of the standard mode is that all noise can couple into the coils, which leads to generally higher noise averages. In environments with noise sources, the benefit in noise reduction by going FIG.-8 more than makes up for the addition of receiver null zones. Accordingly, on a practical basis, the FIG.-8 receiving coil configuration is preferred for most installations, since they are typically noisy. On the other hand, if the noise environment is quiet enough to allow receiving coil operation in standard mode, that mode would be preferred over the FIG.-8 receiving coil configuration.

While the invention is applicable to both transmitting and receiving coils, the ensuing discussion assumes, for convenience, that the transmitting coil configuration is fixed and the receiver coil configuration is variable. The basis of the dynamic shifting, per the invention, is to look upon each receiving coil as a detector, and to assess the noise environment for that coil independently of other participating coils, and per power mains phase where applicable. Further, for convenience of discussion, only two receiving coil configurations are considered, namely, the standard and the FIG.-8 configurations.

Figure 5:
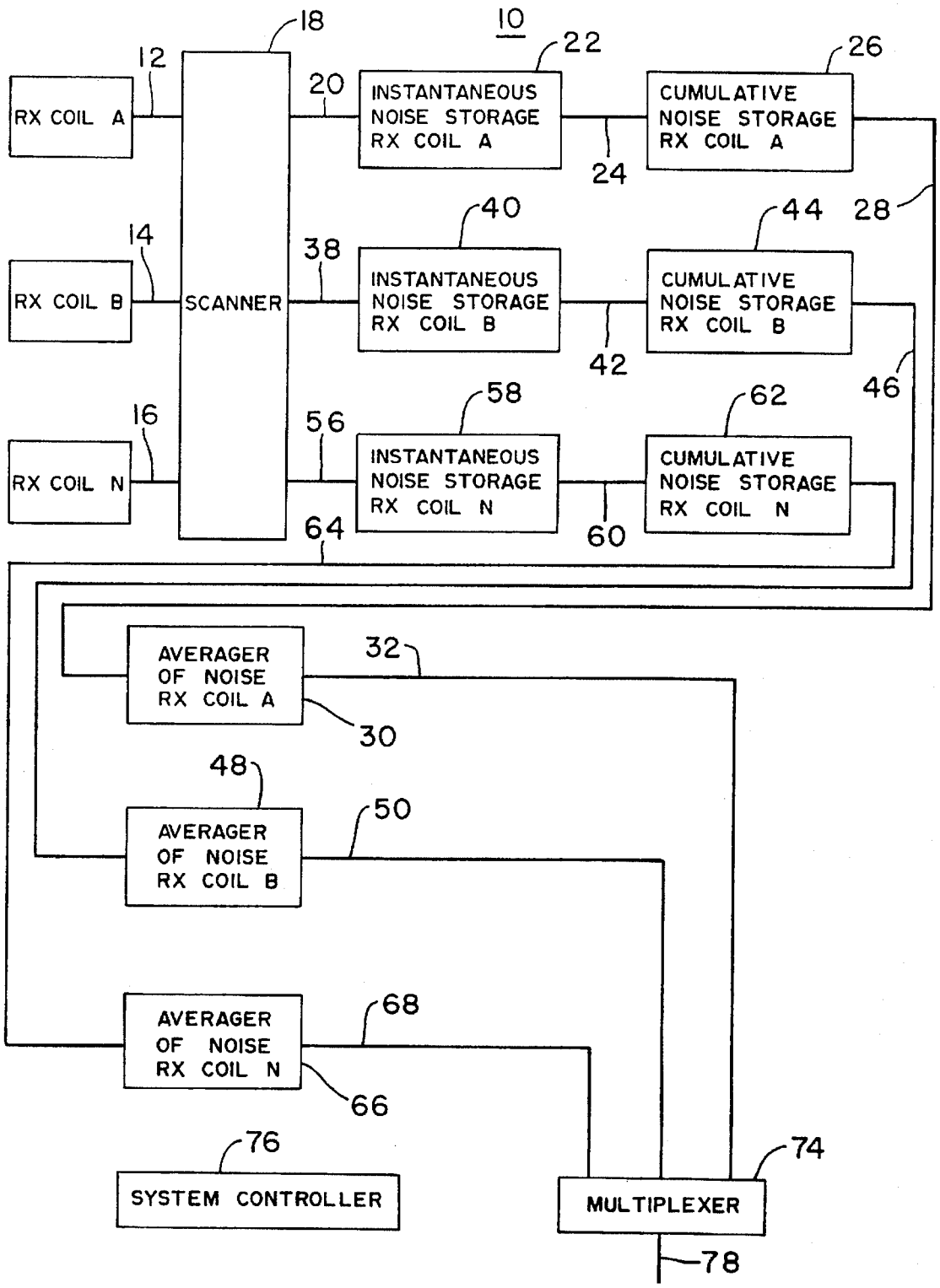
FIG. 5 is a functional block diagram of a first embodiment of an environment noise analyzer of an EAS system in accordance with the invention.

Turning to FIG. 5, noise environment analyzer 10 is shown in combination with receiving coils RX COIL A, RX COIL B, RX COIL N.

The analyzer can be expanded for use with any number of receiving coils, as desired.

The receiving coil output signals are desirably amplified at the coil situs and are furnished over lines 12, 14 and 16 to scanner 18. The scanner looks sequentially at lines 12, 14 and 16 and on looking at each line multiplexes that line with its counterpart one of scanner output lines.

Taking the scan of RX COIL A, scanner 18 connects line 12 to line 20, whereby the noise environment of RX COIL A is conveyed to instantaneous noise storage A 22. The content of storage 22 is furnished over line 24 to cumulative store A 26, whereby the historical record of noise for RX COIL A is compiled and is available on lines 28 noise averager A 30, which outputs average noise for coil A on line 32.

Taking the scan of RX COIL B, scanner 18 connects line 14 to line 38, whereby the noise environment of RX COIL B is conveyed to instantaneous noise storage B 40. The content of storage 40 is furnished over line 42 to cumulative store B 44, whereby the historical record of noise for RX COIL B is compiled and is available on lines 46 for noise averager B 48, which outputs average noise for coil B on line 50.

Taking the scan of RX COIL N, scanner 18 connects line 16 to line 56, whereby the noise environment of RX COIL N is conveyed to instantaneous noise storage N 58. The content of storage 58 is furnished over line 60 to cumulative store N 62, whereby the historical record of noise for RX COIL N is compiled and is available on lines 64 for noise averager N 66, which outputs average noise for coil C on line 68.

Lines 32, 50 and 68 provide inputs to multiplexer 74, the operation of which is controlled by system controller 76. The multiplexer output is provided on line 78.

In the referenced patent application, the multiplexer output is furnished to a receiver variable gain amplifier under control of a system controller such that, as returns from RX COIL A are being processed, the gain of the receiver amplifier is set correspondingly with the average noise A. Thus, the lower the average noise, the higher can be the receiver sensitivity for processing returns from RX COIL A. The system is likewise operated by the controller to maximize receiver sensitivity for RX COIL B and RX COIL N while the receiver is processing returns respectively from these receiving coils.

In accordance with the invention herein, the output of multiplexer 74 is routed to system controller 76 over line 78 in the first system embodiment of FIG. 7, which is below discussed following consideration of FIGS. 6A–6B.

Figure 6A:
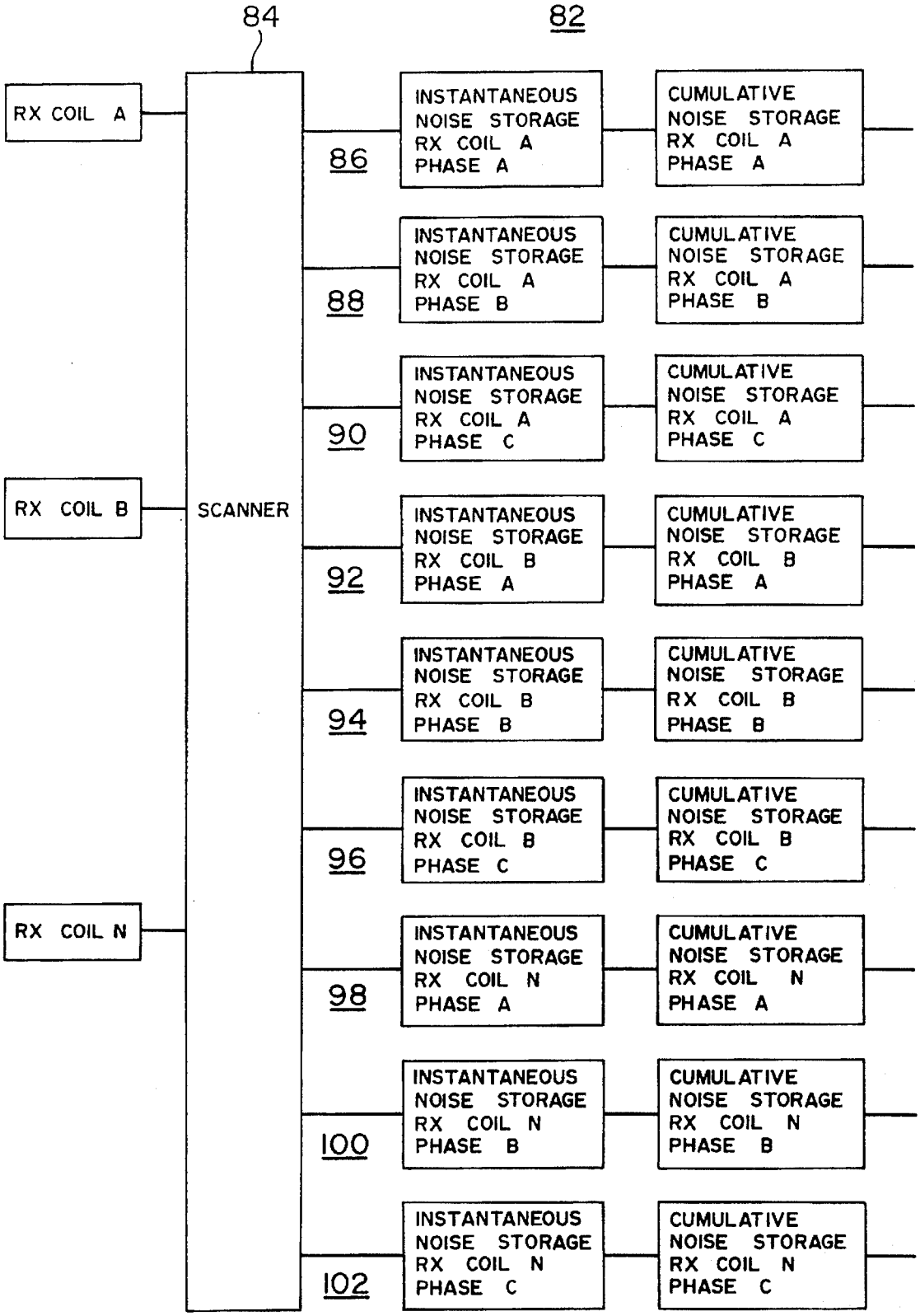
FIG. 6A and 6B show a functional block diagram of a second embodiment of an environment noise analyzer of an EAS system in accordance with the invention.
Figure 6B:
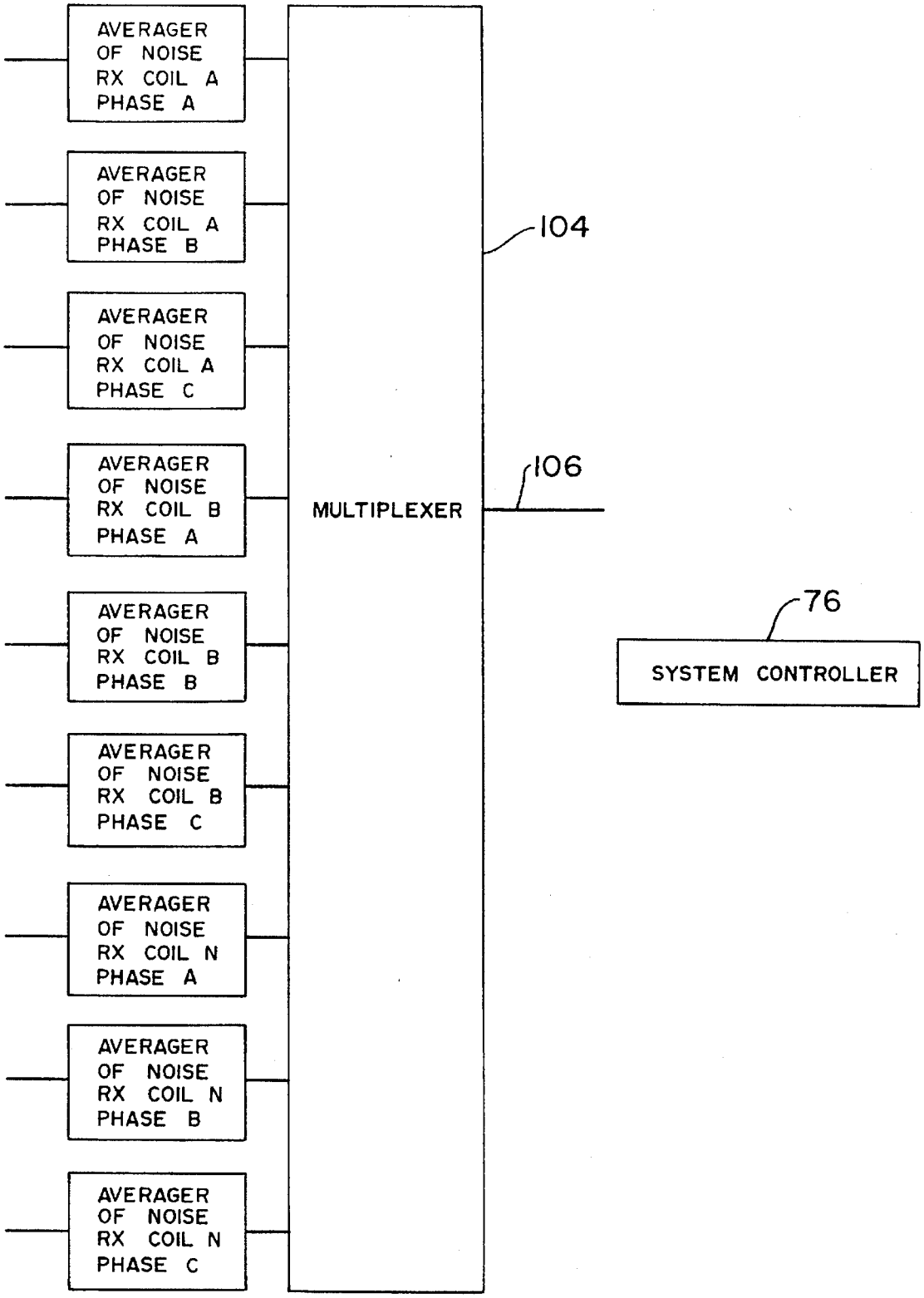

Turning to FIGS. 6A-6B, noise environment analyzer 82 is shown in combination with receiving coils RX COIL A, RX COIL B, RX COIL N.

Whereas, in analyzer 10 of FIG. 5, one channel for average noise computation is provided for each participating receiving coil, in analyzer 82, three channels are provided for each participating coil and output noise averages are provided per coil per phase. Scanner 84 functions as did scanner 18, but is expanded to scan the receiving coils for each of phases A, B and C of the power mains. The participating channels, each of which is configured correspondingly with those of FIG. 1, are noted by reference numerals 86 through 102.

Channel 86 analyzes returns from RX COIL A during phase A, channel 88 analyzes returns from RX COIL A during phase B, and channel 90 analyzes returns from RX COIL A during phase C. Channels 92, 94 and 96 perform likewise for RX COIL B and channels 98, 100 and 102 perform likewise for RX COIL N.

Multiplexer 104 receives the noise averages from each channel under timing control from system controller 76. The multiplexer output is provided on line 106 and is routed to system controller 76 over line 106, in the second system embodiment of FIG. 8, which is below discussed following consideration of the first system embodiment.

The showings of FIGS. 5 and 6A–6B will be seen to implement the one fundamental concept of the invention, above alluded to, i.e., each coil in the system is treated as a separate detection unit with its own noise environment which is distinct from the noise environments of the other coils in the system. The treatment may be on a per coil basis or on a per coil and per phase basis. This allows the system to optimize its performance in coil configuration control.

Figure 7:
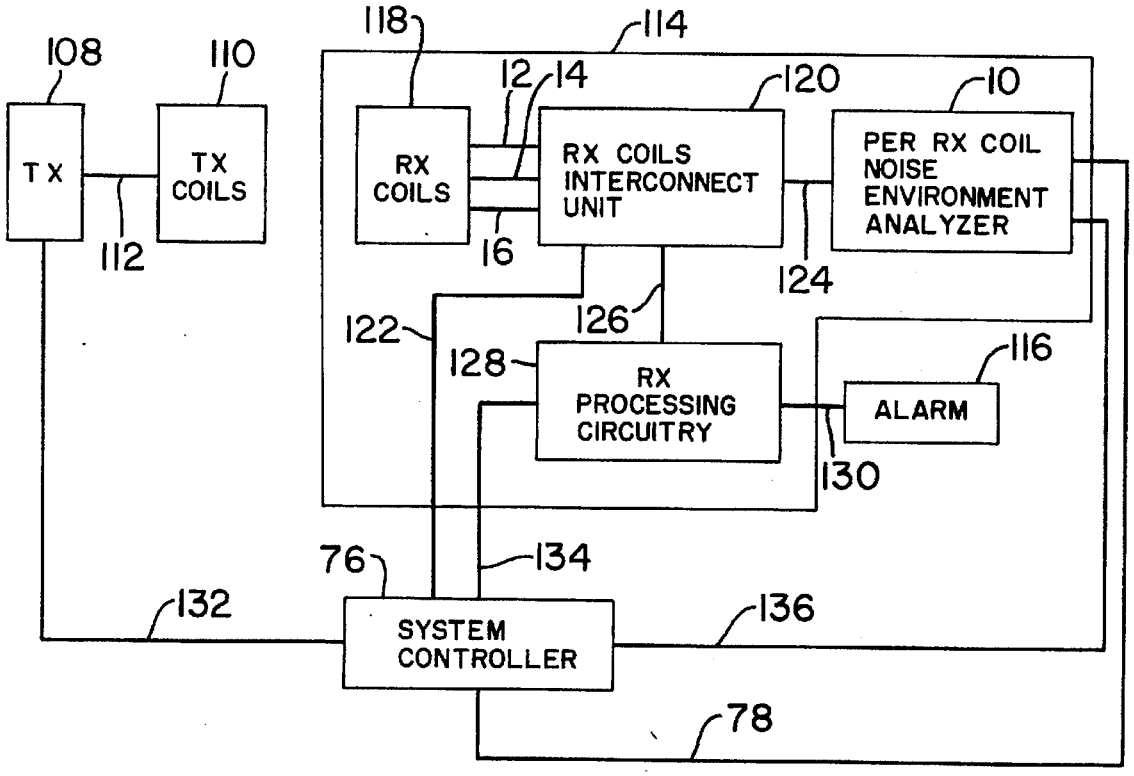
FIG. 7 shows a functional block diagram of a first embodiment of an EAS system in accordance with the invention.

Referring to FIG. 7, the first system embodiment is shown in a functional block diagram and includes transmitter (TX) 108 which drives transmitter coils (TX COILS) 110 over lines 112, a receiver 114, a system controller 76 and an alarm 116. Receiver 114 includes receiver coils 118 (RX COILS), the outputs of which are furnished over lines 12, 14 and 16 to RX COILS INTERCONNECT UNIT 120. Unit 120 is controlled by system controller 76 by signals on lines 122 and furnishes its output signals over line 124 to unit 10 (PER RX COIL NOISE ENVIRONMENT ANALYZER), discussed above, and over lines 126 to tag return processing circuitry 128 (RX PROCESSING CIRCUITRY), which controls alarm 116 over lines 130. System controller 76 has connection with transmitter 108, processing circuitry 128 and analyzer 10 respectively over lines 132, 134 and 136.

FIG. 8 will be seen to show a second system embodiment, which is identical with that of FIG. 7, except for its use of analyzer 82.

The system of the referenced patent application has an active mode, which is composed of a sequence of transmit and noise phases, as alluded to above. Further details of the active mode are set forth in the application and are not relevant to the subject application, which deals not with the active mode, but with a mode which can stand independently or has use as an addendum mode, e.g., a coil connection optimization mode.

Figure 9A:
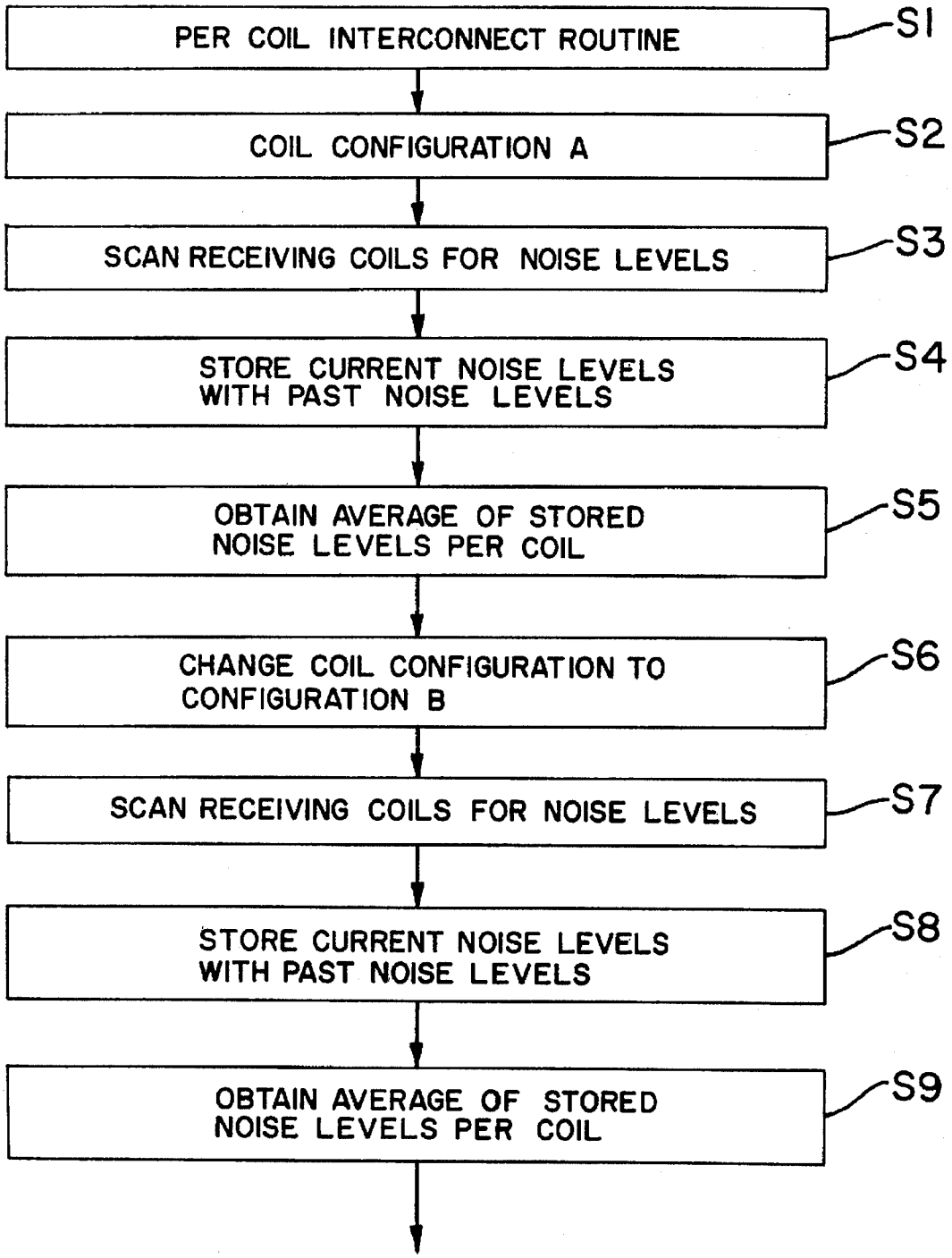
FIGS. 9A and 9B show a flow chart of a receiving coil interconnect routine implemented by a microprocessor of a system controller for the FIG. 7 EAS system.
Figure 9B:
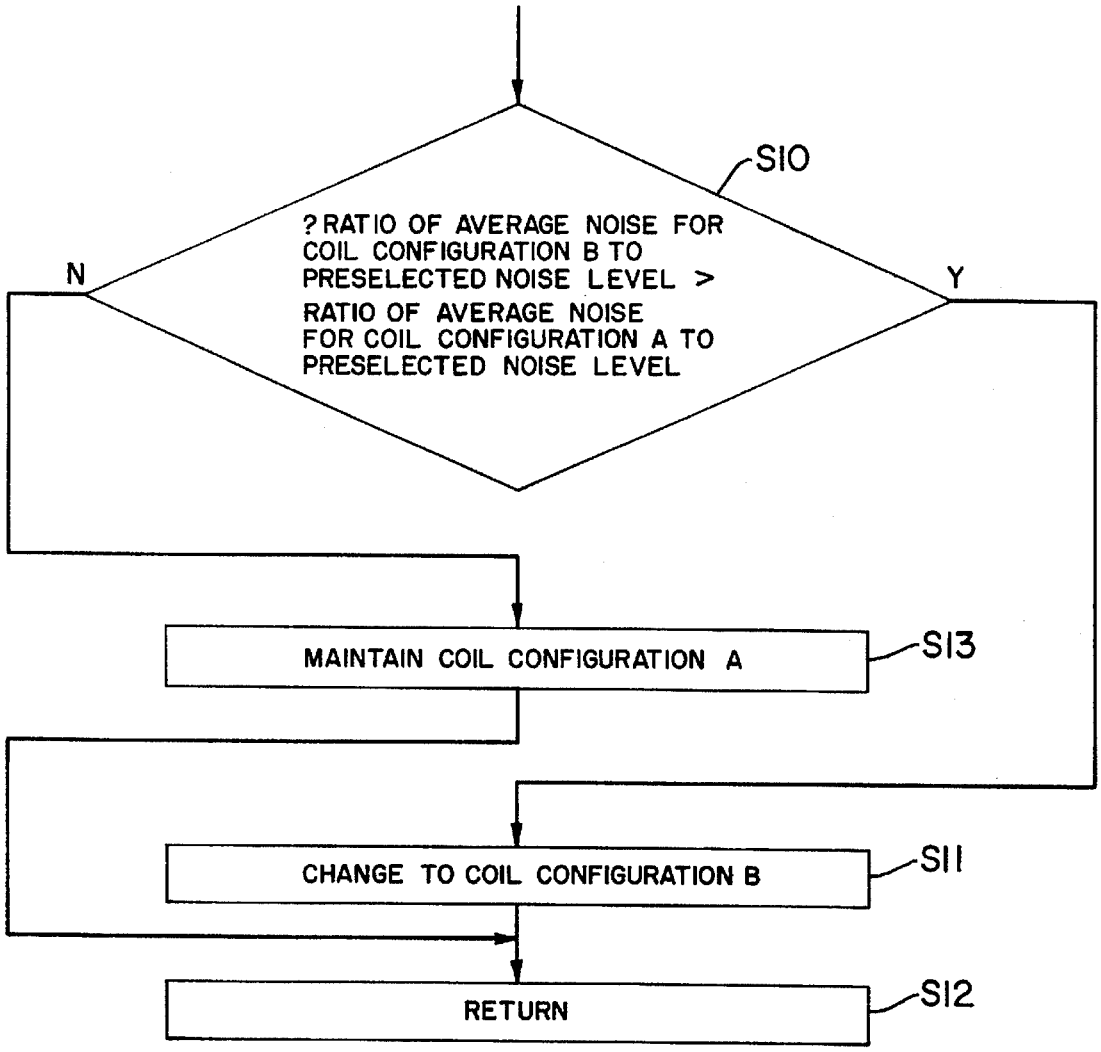

In realizing the first system embodiment, the microprocessor of system controller 76 implements the flow chart of FIGS. 9A and 9B. The routine is entered in step S1, PER COIL INTERCONNECT ROUTINE. In step S2, COIL CONFIGURATION A, the system arranges the receiving coils in, e.g., standard configuration. In step S3, SCAN RECEIVING COILS FOR NOISE LEVELS, operation of analyzer 10 of FIG. 4 commences. In step S4, STORE CURRENT NOISE LEVELS WITH PAST NOISE LEVELS, the instantaneous noise level provided at the output of scanner 18 is stored with prior stored noise levels for each coil. Progress is to step S5, OBTAIN AVERAGE OF STORED NOISE LEVELS PER COIL, and then to step S6, CHANGE COIL CONFIGURATION TO CONFIGURATION B, wherein the system controller directs RX COILS INTERCONNECT UNIT 120 to interconnect the receiving coils to change the coil configuration, e.g., from the standard configuration used above to the FIG.-8 configuration. Progress is successively to step S7, SCAN RECEIVING COILS FOR NOISE LEVELS, step S8, STORE CURRENT NOISE LEVELS WITH PAST NOISE LEVELS, step S9, OBTAIN AVERAGE OF STORED NOISE LEVELS PER COIL, and step S10, ? RATIO OF AVERAGE NOISE FOR COIL CONFIGURATION B TO PRESELECTED NOISE LEVEL> RATIO OF AVERAGE NOISE FOR COIL CONFIGURATION A TO PRESELECTED NOISE LEVEL, wherein inquiry is effectively made as to whether system operation can be enhanced by changing coil interconnection configuration. If the inquiry is answered in the affirmative (Y), step S11 is practiced, CHANGE TO COIL CONFIGURATION B, and the routine ends with step S12, RETURN, and the coil configuration left at its B coil configuration.

Where coil configuration A provides a better noise environment, i.e., its noise compares more favorably with the preselected noise level than does coil configuration B, the step S10 inquiry is answered in the negative (N), and progress is to step S13, MAINTAIN COIL CONFIGURATION A, and the routine ends with step S12, RETURN, and the coil configuration is returned to coil configuration A.

In either case of completion of the routine, RETURN can be to the active mode of the EAS system of the referenced application or of any desired EAS system employing a plurality of receiving coils.

It is important to note that step S10 calls out a "PRESELECTED NOISE LEVEL" for each configuration and that the respective preselected noise levels need differ for standard and FIG.-8 coil configurations. When one goes to the FIG.-8 coil configuration, the noise necessary decreases inherently, based on the cancellation of noise as between the oppositely-phased coils. Were the same preselected noise level used in evaluating both standard and FIG.-8 coil configurations, the FIG.-8 coil configuration would likely always win the contest. Accordingly, the preselected noise level for comparison purposes is set higher for the FIG.-8 coil configuration than for the standard configuration.

In configuring RX COILS INTERCONNECT UNIT 120, the invention contemplates the connection of the terminals of all participating receiving coils to input terminals of an electronic crosspoint switch and the output terminals of the crosspoint switch to lines 124 of FIG. 7. System controller 76 accordingly provides input to the crosspoint switch to cause the same to effect the diverse coil configurations as called for by the routine of FIGS. 9A and 9B.

As an alternative to the routine of FIGS. 9A and 9B for the FIG. 7 system, the invention contemplates a routine having steps S1 through S5 of FIG. 9A, a step of comparing the noise level of the coil configuration A with the preselected noise level and simply not changing coil configuration if the noise of coil configuration A compares favorably with the preselected noise level.

Figure 10A:
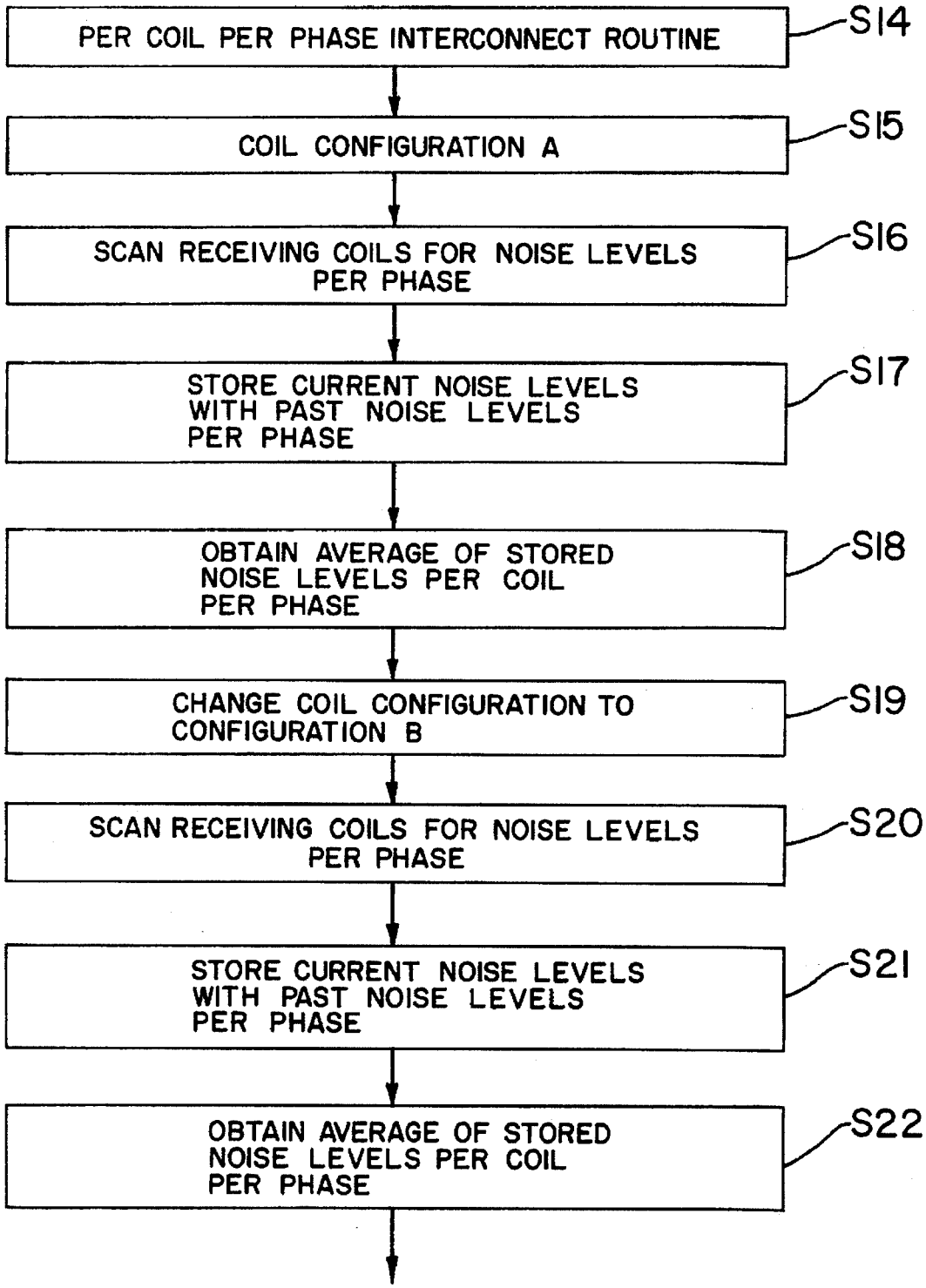
FIGS. 10A and 10B show a flow chart of a receiving coil interconnect routine implemented by a microprocessor of a system controller for the FIG. 8 EAS system.
Figure 10B:
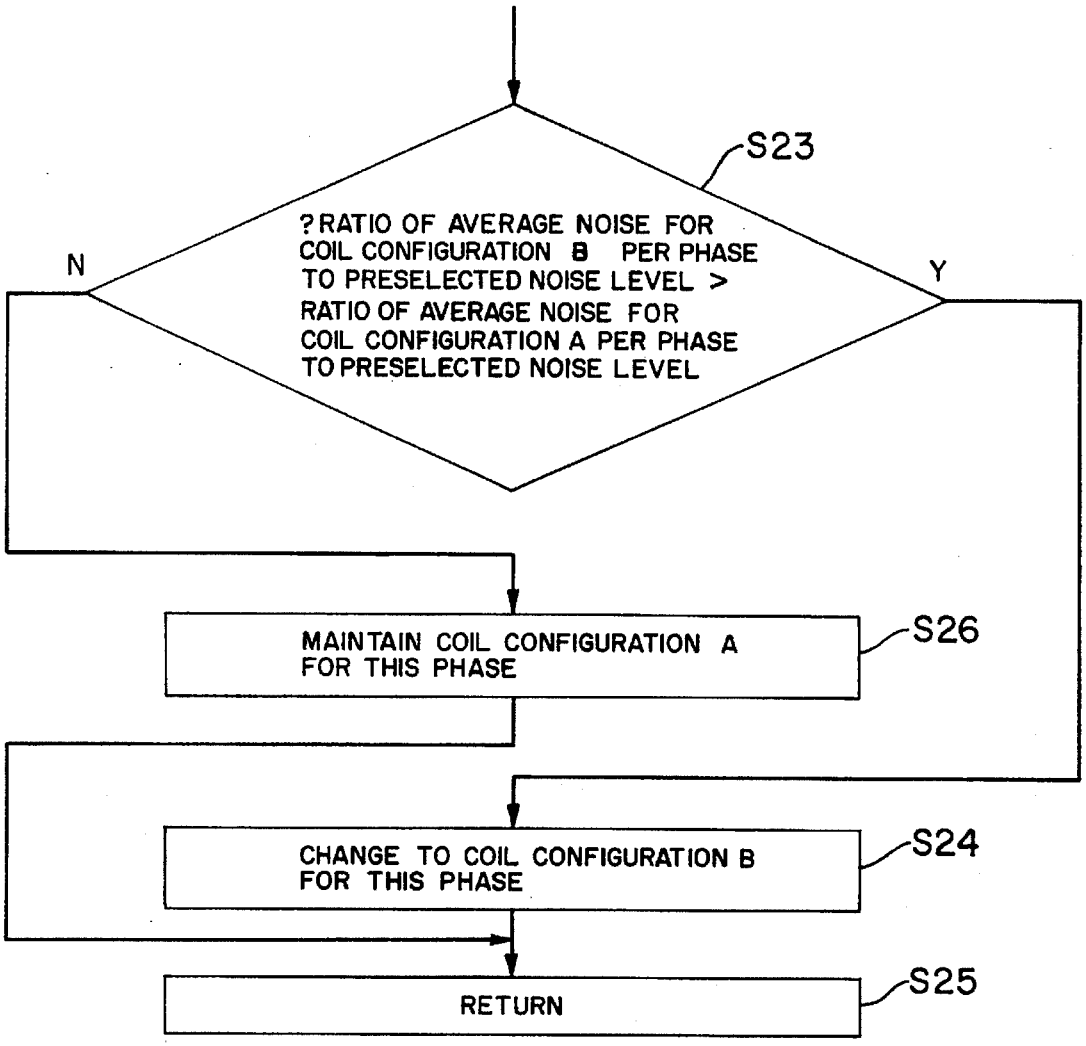

In realizing the second system embodiment, the microprocessor of system controller 76 implements the flow chart of FIGS. 10A and 10B. The routine is entered in step S14, PER COIL PER PHASE INTERCONNECT ROUTINE. In step S15, COIL CONFIGURATION A, the system arranges the receiving coils in, e.g., standard configuration. In step S16, SCAN RECEIVING COILS FOR NOISE LEVELS PER PHASE, operation of analyzer 82 of FIGS. 6A–6B commences. In step S17, STORE CURRENT NOISE LEVELS WITH PAST NOISE LEVELS PER PHASE, the instantaneous noise level provided at the output of scanner 84 is stored with prior stored noise levels for each coil per phase. Progress is to step S18, OBTAIN AVERAGE OF STORED NOISE LEVELS PER COIL PER PHASE, and then to step S19, CHANGE COIL CONFIGURATION TO CONFIGURATION B, whereupon the system controller directs RX COILS INTERCONNECT UNIT 120 to interconnect the receiving coils to change the coil configuration, e.g., from the standard configuration used above to the FIG.-8 configuration. Progress is successively to step S20, SCAN RECEIVING COILS FOR NOISE LEVELS PER PHASE, step S21, STORE CURRENT NOISE LEVELS WITH PAST NOISE LEVELS PER PHASE, step S22, OBTAIN AVERAGE OF STORED NOISE LEVELS PER COIL PER PHASE, and step S23, ? RATIO OF AVERAGE NOISE FOR COIL CONFIGURATION B PER PHASE TO PRESELECTED NOISE LEVEL>RATIO OF AVERAGE NOISE FOR COIL CONFIGURATION A PER PHASE TO PRESELECTED NOISE LEVEL. The above comments on different preselected noise levels for the respective different coil configurations applies also to step S23.

In step S23, inquiry is effectively made as to whether system operation can be enhanced by changing coil interconnection configuration. If the inquiry is answered in the affirmative (Y), step S24 is practiced, CHANGE TO COIL CONFIGURATION B FOR THIS PHASE, and the routine ends with step S25, RETURN, and the coil configuration left at its B coil configuration.

Where the step S23 inquiry is answered in the negative (N), progress is to step S26, MAINTAIN COIL CONFIGURATION A FOR THIS PHASE, and the routine ends with step S25, RETURN, and the coil configuration returned to coil configuration A.

As an alternative to the routine of FIGS. 10A and 10B for the FIG. 8 system, the invention contemplates a routine having steps S1 through S5 of FIG. 10A, a step of comparing the noise level of the coil configuration A per phase with the preselected noise level and simply not changing coil configuration if the noise of coil configuration A per phase compares favorably with the preselected noise level.

Figure 11:
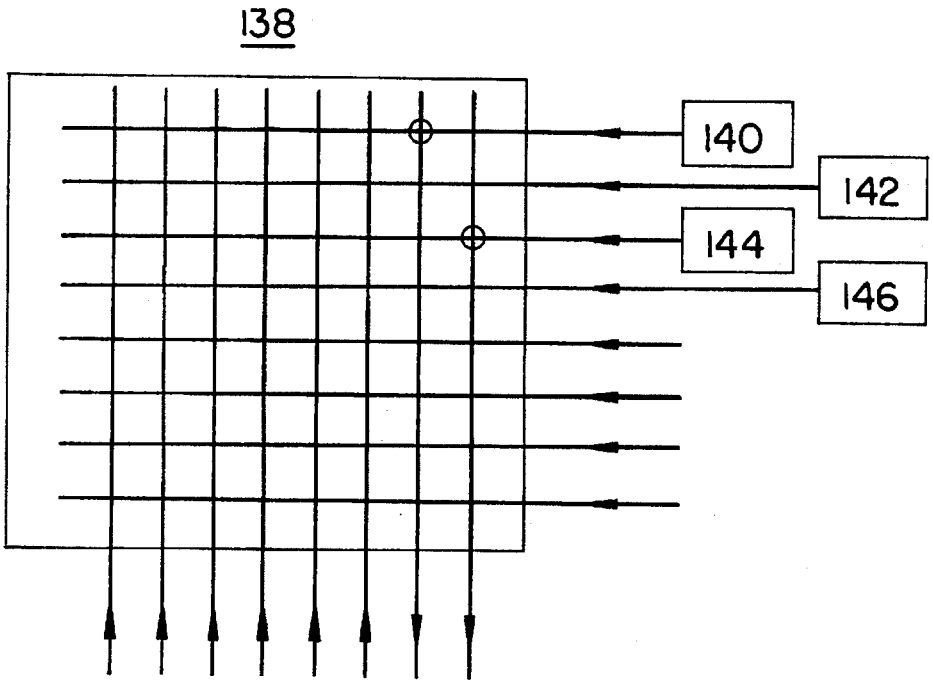
FIG. 11 depicts a first embodiment of an electronic crosspoint switch for evaluation of standard or FIG.-8 configuration coil interconnections.

An electronic crosspoint switch 138 for use in implementing the routines of FIGS. 9A, 9B and 10A, 10B is shown in FIG. 11. As seen therein, a eight-by-eight switch has eight horizontal conductors and eight vertical conductors. The intersections of the horizontal conductors with the vertical conductors are nodes at which connections may be made. Each node provides a wide bandwidth analog connector for passing signals. Each matrix connection can therefore serve as either an input or output bus. As configured in FIG. 11, the two rightmost vertical conductors provide the switch outputs. All other conductors can be connected individually to participating receiving coils.

The basic arrangement of FIG. 11 is capable of connecting coils in the standard configuration, i.e., to connect a single input (coil) to each output and to measure signal levels. Per microprocessor control of active (connected) nodes, progress is to make further pairs of nodes active, and to further measure signal levels, etc.

In the simplified FIG. 11 arrangement, a two pedestal, four coil arrangement is presented, wherein coil 140 may be the top coil of the first pedestal, coil 142 the bottom coil of the first pedestal, coil 144 the top coil of the second pedestal and coil 146 the bottom coil of the second pedestal.

The open circles in FIG. 11 indicate an active node condition of switch 138 in which coil 140 and coil 144 are under examination, being connected to the switch output conductors.

Figure 12:
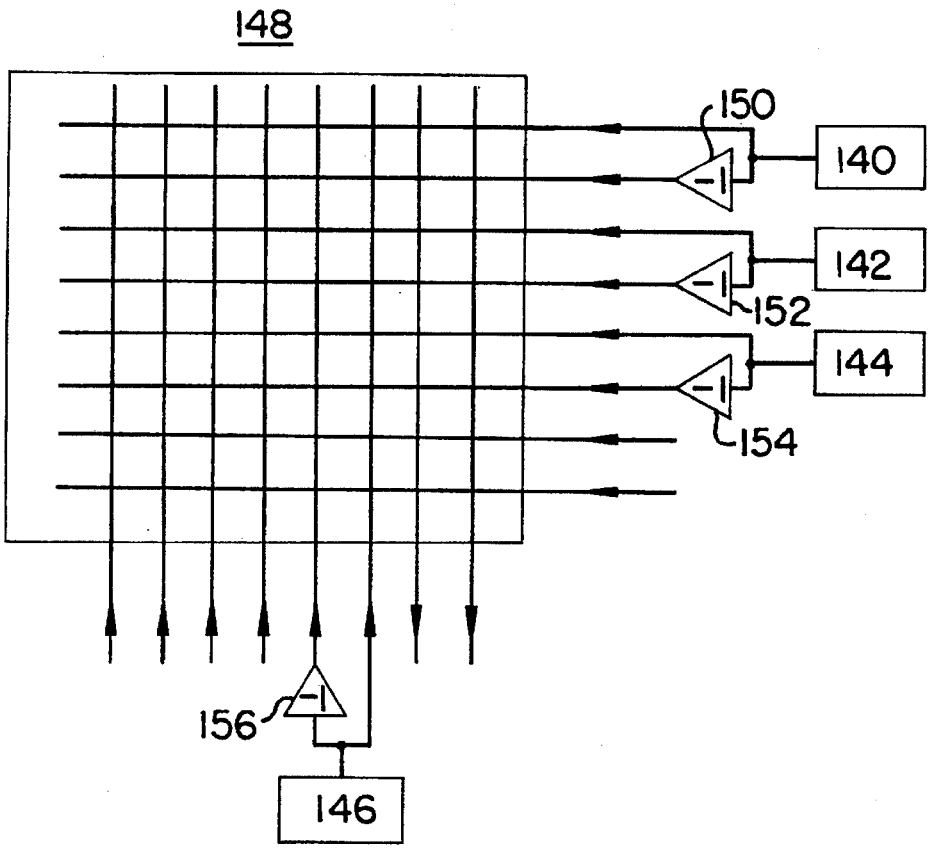
FIG. 12 depicts a second embodiment of an electronic crosspoint switch for concurrent evaluation of standard configuration coil interconnections and FIG.-8 configuration coil interconnections.

Crosspoint switch 148 of FIG. 12 has facility for examining receiving coils in both standard and FIG.-8 configurations. Coils 140, 142, 144 and 146 are connected directly to switch conductors and are further connected to inverters 150, 152, 154 and 156 and the inverter outputs are connected to switch conductors. The switch accordingly has available to it both normal and inverted signals from each coil.

Creating FIG.-8 configurations with switch 148 is effected by connecting any two signals of opposing phase, i.e., a normal signal and an inverted signal to a single output bus. Doing so will effectively null portions of the input signal that are mirrored in the two inputs.

As will be appreciated, use of switch 148 allows further for the connection and monitoring of both standard inputs and FIG.-8 inputs simultaneously and leads to a third embodiment of the invention, now discussed.

In the third embodiment, all participating receiving coils are examined in both standard and FIG.-8 configurations concurrently, using parallel hardware involving switch 148. While the third embodiment carries the burden of additional hardware, it offers the benefit of having multiple configuration choices available concurrently and not having to take "time out" now and again to evaluate optimum coil configurations.

By way of summary and introduction to the ensuing claims, in one aspect, the invention will be seen to provide, in combination, in an electrical article surveillance system, a plurality of receiving coils, a noise environment analyzer for determining the noise environment individual to each of the receiving coils and a receiver coil interconnecting unit for variably interconnecting the receiving coils responsively to noise environment determinations of the noise environment analyzer.

The noise environment analyzer includes scanning circuitry for individually connecting the receiving coils thereto and has separate noise analysis channels respectively for each receiving coil.

The noise environment analyzer further includes in each channel thereof first circuitry for individual storing of signals received by the receiving coils, second circuitry for cumulative storage of signals stored by the first circuitry, and third circuitry for averaging the signals stored by the second circuitry.

The noise environmental analyzer further includes multiplexer circuitry for receiving the output signals of the third circuitry and for generating output signals selectively indicative of the third circuitry output signals.

The system transmitter may be powered from a multiphase power source. In that case, the noise environment analyzer further includes separate noise analysis channels respectively for each the receiving coil and for each phase of the multi-phase power source means. The noise analysis channels are arranged in groups corresponding in number to the number of receiving coils and wherein each noise analysis channel group comprises channels in number corresponding to the number of phases of the multi-phase power source.

Noise analysis and coil configuration change can be practiced concurrently with EAS system operation or may be practiced during periods in which the EAS system is rendered inactive.

Various changes in structure to the described systems and apparatus and modifications in the described practices may evidently be introduced without departing from the invention. Accordingly, it is to be understood that the particularly disclosed and depicted embodiments are intended in an illustrative and not in a limiting sense. The true spirit and scope of the invention are set forth in the following claims.

What is claimed is:

1. In combination, in an electrical article surveillance system:

(a) a plurality of receiving coils;

(b) noise environment analysis means for determining the noise environment individual to each of said receiving coils; and (c) receiver coil interconnecting means for variably interconnecting said receiving coils responsively to noise environment determinations of said noise environment analysis means.

2. The invention claimed in claim 1, wherein said noise environment analysis means includes scanning means for individually connecting said receiving coils thereto.

3. The invention claimed in claim 2, wherein said noise environment analysis means further includes separate noise analysis channels respectively for each said receiving coil.

4. The invention claimed in claim 3 further including transmitting means for transmitting energy to said receiving coils and multi-phase power source means for excitation of said transmitting means, wherein said noise environment analysis means further includes separate noise analysis channels respectively for each said receiving coil and for each phase of said multi-phase power source means.

5. The invention claimed in claim 4, wherein said noise analysis channels are arranged in groups corresponding in number to the number of receiving coils and wherein each noise analysis channel group comprises channels in number corresponding to the number of phases of said multi-phase power source.

6. The invention claimed in claim 5, wherein each said noise analysis channel includes first means for storing of signals received by a distinct one of said receiving coils for a distinct phase of said multi-phase power source.

7. The invention claimed in claim 6, wherein each said noise analysis channel further includes second means for cumulative storage of signals stored by said first means thereof.

8. The invention claimed in claim 7, wherein each said noise analysis channel further includes third means for averaging the signals stored by said second means thereof.

9. The invention claimed in claim 8, wherein said noise environmental analysis means further includes multiplexer means for receiving said output signals of said third means of each of said channels and for generating output signals selectively indicative of the received third means output signals.

10. The invention claimed in claim 2, wherein said noise environment analysis means further includes first means for individual storing of signals received by said receiving coils.

11. The invention claimed in claim 10, wherein said noise environment analysis means further includes second means for cumulative storage of signals stored by said first means.

12. The invention claimed in claim 11, wherein said noise environmental analysis means further includes third means for averaging the signals stored by said second means.

13. The invention claimed in claim 12, wherein said noise environmental analysis means further includes multiplexer means for receiving said output signals of said third means and for passing output signals selectively indicative of the output signals of said third means.

14. In combination, in an electrical article surveillance system:

(a) a first plurality of transmitting coils and a second plurality of receiving coils;

(b) noise environment analysis means connected to one of said first and second coil pluralities for determining the noise environment individual to each of the coils of said plurality connected thereto; and (c) coil interconnecting means for variably interconnecting the one of said first and second coil pluralities responsively to noise environment determinations of said noise environment analysis means.

15. In combination, in an electrical article surveillance system:

(a) a plurality of receiving coils; and (b) noise environment analysis means for determining the noise environment individual to each of said receiving coils concurrently in mutually different interconnection configurations of said receiving coils.

16. The invention claimed in claim 15, wherein said noise environment analysis means includes switching means having inputs comprising a normal and an inverted signal from each of said coils.

17. The invention claimed in claim 16, wherein said noise environment analysis means further includes inverting circuit means connected to each of said coils for providing said inverted signals input to said switching means.

18. The invention claimed in claim 15, further including receiver coil interconnecting means for variably interconnecting said receiving coils responsively to noise environment determinations of said noise environment analysis means.

19. The invention claimed in claim 18, wherein said noise environment analysis means includes switching means having inputs comprising a normal and an inverted signal from each of said coils.

20. The invention claimed in claim 19, wherein said noise environment analysis means further includes inverting circuit means connected to each of said coils for providing said inverted signals input to said switching means.

* * * * *